US005231971A

United States Patent [19]

York et al.

[11] Patent Number: 5,231,971

[45] Date of Patent: Aug. 3, 1993

[54] BOW CENTER SET, NOCK SET AND TILLER GAUGE

[76] Inventors: Merinth S. York, 639 S. Elm St., Mesa, Ariz. 85202; Lee W. Ester, 4627 W. Elgin St., Chandler, Ariz. 85226

[21] Appl. No.: 774,052

[22] Filed: Oct. 8, 1991

[51] Int. Cl.[5] ..... F41B 5/00

[52] U.S. Cl. ..... 124/90; 124/88; 124/23.1

[58] Field of Search ..... 124/23.1, 24.1, 90, 124/88, 86, 25.6, 44.5, 91; 33/506, 265

[56] References Cited

U.S. PATENT DOCUMENTS

| | | | |
|---|---|---|---|
| 3,088,212 | 5/1963 | Smith | 33/506 |
| 3,111,772 | 11/1963 | Hartog | 33/506 |
| 3,651,578 | 3/1972 | Saunders et al. | 33/506 |
| 3,957,027 | 5/1976 | Drake | 124/88 |
| 3,969,825 | 7/1976 | Mathes | 124/90 X |
| 4,382,339 | 5/1983 | Saunders | 33/506 X |
| 4,398,354 | 8/1983 | Finlay | 33/506 |
| 4,594,786 | 6/1986 | Rezmer | 33/506 |
| 5,060,627 | 10/1991 | Fenchel | 124/24.1 X |

*Primary Examiner*—Randolph A. Reese
*Assistant Examiner*—Anthony Knight
*Attorney, Agent, or Firm*—James F. Duffy

[57] ABSTRACT

A bow tuning tool has two coupling mechanisms. The first of these coupling mechanisms makes coupling contact with the archer's bow. The second makes coupling contact with an arrow shaft. By coupling the arrow shaft to the tool and bringing the tool into coupling contact with the bow, tuning adjustments to the blow are facilitated. A three-in-one bow tuning tool is derived: a Bow Square and Nock Set, used to set the height of an adjustable arrow rest and to locate nock points; a Bow Center set for setting the flight path of the arrow shaft past the bow; and, a Bow Tiller Gauge to equalize the setting of the tiller height above and below the point on the bow at which the bow is gripped.

9 Claims, 2 Drawing Sheets

BOW CENTER SET, NOCK SET AND TILLER GAUGE

BACKGROUND

1. Field of the Invention

The invention relates to devices for tuning a bow prior to using the bow to launch an arrow on its flight. In particular, the invention relates to a Bow Center Set for setting the flight path of an arrow shaft past the blow; a Nock Set for setting the height of an adjustable arrow rest mounted on the bow; and, a Bow Tiller Gauge used to equalize the setting of the tiller height of the bow above and below the bow grip.

2. Prior Art

An archer will adjust his bow in an attempt to assure that an arrow, launched from that bow, will fly straight and true. This adjustment of the archer's bow is frequently referred to as tuning the bow. As may well be imagined, in a sport as ancient as that of archery, many devices have been devised to assist the archer in tuning his bow.

An example of one such device is illustrated in the U.S. patent to G. E. Smith, U.S. Pat. No. 3,088,212, issued May 7, 1963. Smith's device is a bow square. As he teaches its use, it serves two purposes. The first is that of a measuring device for determining the "bracing height" or "fistmele" of the bow. The bracing height, or fistmele, is the distance between the bow grip and the bow string. This measurement is especially important with today's compound bows wherein the inclination of the upper and lower limbs with respect to the bow grip may be individually adjusted.

The second purpose served by Smith's Bow Square is that of determining the position for nocking the arrow on the bow string. Smith's Bow Square has markings for determining the nock points on the bow string.

The nock points are marked by a string or a clinched metal bead, or the like, and enable the archer to fit the nock of the arrow at the same point on the bow string each time he launches an arrow.

Smith's Bow Square is in the shape of a T-square. The central leg of the T is approximately 10 inches long and the arm of the T four inches. Because of its size, which is typical of many of the bow tools available to the archer, the bow square is not always convenient to carry; and so, it is often not available to the archer when most needed in the field or during a competition. It is the intention of the present invention to provide a bow tuning tool of convenient size and dimensions to enable it to be carried in an archer's pocket from where it may be called into immediate use. It is intended that the longest and, therefore, the most generally awkward part of a bow tuning tool to conveniently transport, shall be eliminated and, substituted in its place, an article which the archer will always have ready in hand.

SUMMARY OF THE INVENTION

The invention may be described generically as apparatus for tuning a bow. As such, the invention comprises a bow having a bow grip, an upper limb, a lower limb, and a bow string; an arrow shaft; and a bow tuning tool. The bow tuning tool has first means for making coupling contact with the bow. In addition there are second means for making coupling contact with an arrow shaft. By coupling the arrow shaft to the tool, and by bringing the tool into coupling contact with the bow, tuning adjustments to the bow are facilitated.

Several presently preferred embodiments meeting that generic description are disclosed. In the first, the arrow shaft has a nock end for receiving an arrow nock; and, the bow tuning tool is a Bow Square and Nock Set. The Bow Square and Nock Set is useful to facilitate setting the height of an adjustable arrow rest mounted on the bow, and in locating nock points on the bow string.

In the Bow Square and Nock Set, the first means comprises means movably coupling the tool to the bow string. An, the second means comprises means coupling the tool to the nock end of the arrow shaft. The arrow shaft lies in a plane orthoginal to the bow string and extends toward the bow when the tool is movably coupled to the bow string.

In a second of the disclosed, preferred embodiments, the arrow shaft has an arrow nock in the nock end. The bow tuning tool is a Bow Center Set useful to facilitate setting the flight path of the arrow shaft past the bow. The first means comprises angular observation means, adjustably coupled to the tool, and movably coupling the tool to the bow along the flight path of the arrow shaft. The second means comprises means coupling the tool to the arrow shaft while the shaft is nocked to the bow string. The arrow shaft lies on a line extending past the bow at an angular disposition indicated by the angular observation means; and the tool facilitates setting of that angular disposition.

In the third of the presently preferred embodiments, the bow has first and second adjustment means coupling, respectively, the upper and the lower limbs to the bow grip. Here, the bow tuning tool is a Bow Tiller Gauge useful to facilitate equalization of the setting of the tiller height above and below the bow grip. The first means comprises means coupling the tool to the bow string; and, the second means comprises means coupling the arrow shaft to the tool. The arrow shaft lies along a line parallel to the bow string when the tool is coupled to the bow string.

Advantageously, the bow tuning tool comprises, in combination: (1) a Bow Square and Nock Set useful to facilitate setting the height of an adjustable arrow rest mounted on the bow, and in locating nock points on the bow string; (2) a Bow Center Set useful to facilitate setting the flight path of the arrow shaft past the bow; and, (3) a Bow tiller Gauge useful to facilitate equalization of the setting of the tiller height above and below the bow grip.

A DETAILED DESCRIPTION OF THE INVENTION

Figure 1:
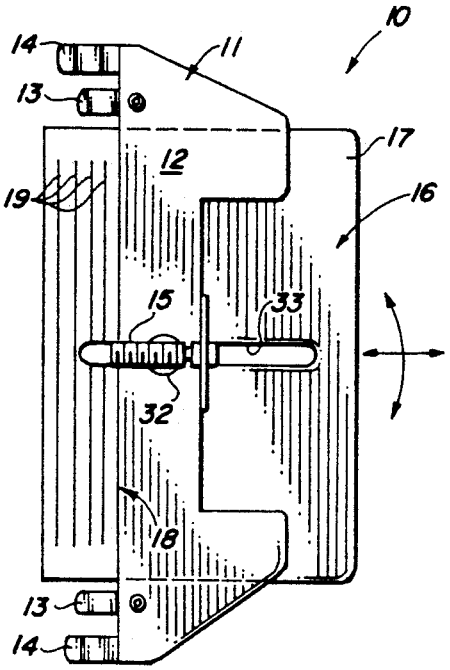
FIG. 1 illustrates the bow tuning tool of the invention in an embodiment which incorporates a bow square, a center set, and a bow tiller gauge into one handly, convenient to carry, tool.

For purposes of promoting an understanding of the principles of the invention, reference will now be made to the embodiments illustrated in the drawings and specific language will be used to describe same. It will nevertheless be understood that no limitation of the scope of the invention is thereby intended, there being contemplated such alterations and modifications of the illustrated device, and such further applications of the principles of the invention as discloses herein, as would normally occur to one skilled in the art to which the invention pertains.

The invention, a bow tuning tool, is illustrated in FIG. 1 as a combination 10 of several bow tuning tools. The tool is intended for use with a bow which has a bow grip, an upper limb, a lower limb, and a bow string. An arrow shaft is incorporated with the tool for use in tuning the bow. Such a bow illustrated in FIG. 7 in the accompanying drawings. In each of the tools making up the combination 10 of FIG. 1 there is a common, generic base. Each of the tools has means for making coupling contact with the bow; and, each of the tools also has means for making coupling contact with the arrow shaft. In use, the arrow shaft is coupled to the tool; and, the tool is brought into coupling contact with the bow. Tuning adjustments may then be made to the bow utilizing the tool.

The several tools shown in the combination 10 of FIG. 1 comprise the bow square and tiller gauge 11 and the center set 16. The tiller gauge is comprised of body 12, bow string attachment clips 13 and arrow shaft attachment clips 14. The bow square (also a nock set) is comprised of body 12, bow string attachment clips 13 and an arrow shaft coupler 15. Bow center set 16 utilizes the following elements: the body 12, arrow shaft attachment clips 14, alignment gauge 17, alignment gauge edge 18 at the edge of body 12, and alignment marks 19 on gauge 17. The manner in which the tool is used for these multiple functions will be detailed in the discussion following.

Figure 2:
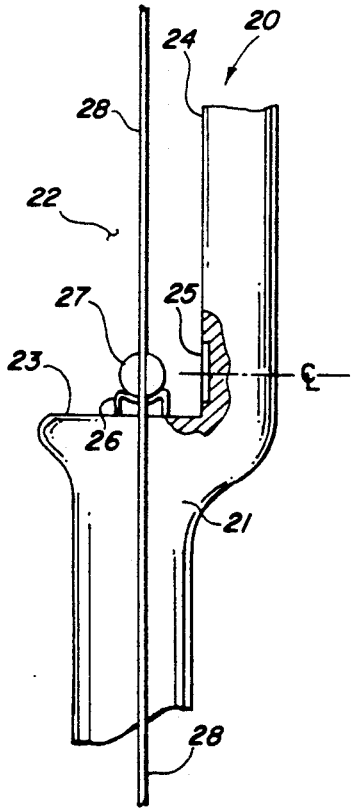
FIG. 2 illustrates the desired placement of an arrow shaft on an arrow rest whose height has been adjusted to place the arrow at the center line of the bow and its position on the bow has been adjusted such that the arrow lies in the plane in which the bow string is drawn and released. Further, the arrow is positioned on the bow string and the arrow rest such that the arrow shaft is orthoginal to the bow string.

In tuning a bow, a desired geometry between the bow and the arrow shaft is sought. In FIG. 2, a portion of a bow 20 is indicated. In bow grip 21, a cutout 22 produces a shelf 23 and a riser 24. On riser 24, a center line mark 25 is embedded or otherwise indicated. An adjustable arrow rest 26 is positioned on shelf 22. For simplification, the means for adjusting arrow rest 26 are now shown.

Figure 5:
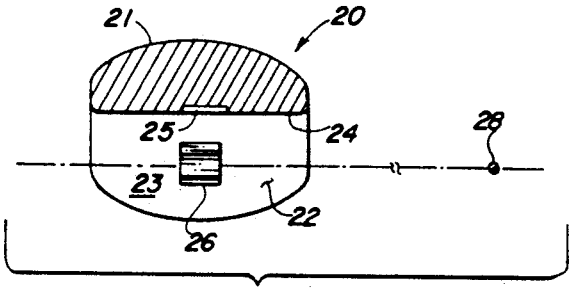
FIG. 5 is a cross sectional view of the bow taken along line 5—5 of FIG. 3 further illustrating the desired geometry first shown in FIG. 2.

Ideally, it is desired that arrow shaft 27, positioned in arrow rest 26, will lie on the center line of bow 20 is indicated by mark 25. Further, arrow shaft 27 shall lie on a line which is orthoginal to bow string 28; and, this line shall lie in a plane in which bow string 28 lies as it is released to launch arrow shaft 27 into flight. The bow tuning tools of the invention will establish the height of arrow rest 26 to place arrow shaft 27 on the center line of bow 20; will indicate the position of arrow rest 26 on shelf 22 to place the arrow shaft within the plane of movement of the drawn and released bow string 28; and, will locate the position on the bow string at which the arrow shaft shall be nocked such that arrow shaft 27 will be orthoginal to bow string 28 in the bow string's nominal resting position. A top view of FIG. 2 is shown in FIG. 5.

Figure 3:
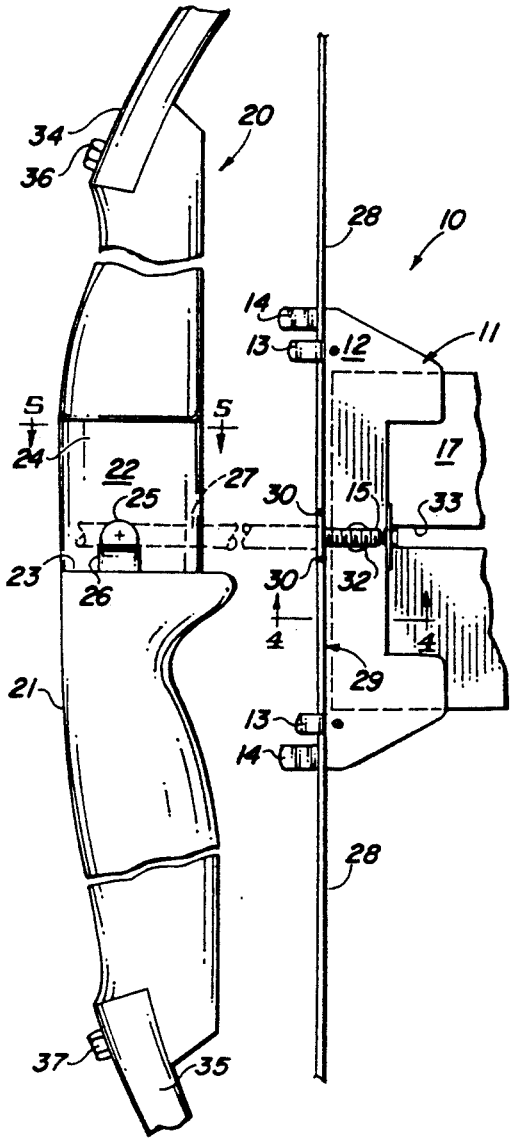
FIG. 3 illustrates the tool being used as a bow square and nock set. The tool is affixed to the bow string and an arrow shaft, shown in phantom outline, serves as the leg of a T-square.

To locate arrow shaft 27 on a line orthoginal with the bow string 28, the bow string being at rest, a bow square is employed. This usage is illustrated in FIG. 3. The body of combination tool 10 is affixed to a bow string 28 by means of bow string clips 13. Clips 13 firmly grasp bow string 28 so as to maintain edge 29, on body 12, in parallel contact with bow string 28.

Arrow shaft 27 is illustrated in phantom outline. Arrow shaft 27 has a nock end to which a nock is intended to be thread coupled. In the illustration of FIG. 3, the nock has been removed and arrow shaft 27 has its nock end threadedly coupled to arrow shaft coupled 15 on body 12. The coupling is such that arrow shaft 27 extends toward hand grip 21 of bow 20 along a line which is generally orthoginal to bow string 28. However, the line along which arrow shaft 27 extends does not intersect bow string 28. It is more proper to say that arrow shaft 27 lies in a plane which is orthoginal to the bow string. The reason for this is shown in FIG. 4 which is a cross section taken along lines 4—4 of FIG. 3.

Figure 4:
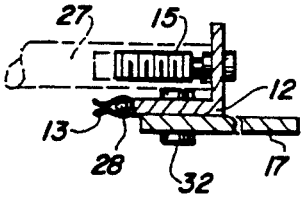
FIG. 4 is a cross sectional view taken along lines 4—4 of FIG. 3 showing the manner in which bow shaft is affixed to the tool at the nock-end of the arrow shaft. Note that the arrow shaft lies in a plane adjacent to the plane in which the bow string is drawn and released. This permits positioning the tool on the bow string such that the arrow shaft is closer to the center line marking on the bow.

In FIG. 4 it is seen that arrow shaft coupler 154 is a threaded shaft which extends parallel to the surface of body 12, and adjacent to bow string 28 positioned within bow string clip 13. In this arrangement, wherein the arrow shaft is offset to one side of bow string 28, there is an inherent advantage in that the arrow may be located close to center line marker 25 on bow grip riser 24. The reader should note that the drawing of FIG. 3 was drawn in a manner to preclude the necessity of drawing hidden lines to illustrate bow shaft coupler 15. In the arrangement of the drawing of FIG 3, arrow shaft 27 would stand outward from the drawing, away from center line marker 25. In actual practice, body 12 of tool 10 would be reversed so that arrow shaft coupler 15 would be hidden from view, as the drawing is viewed in FIG. 3, and arrow shaft 27 would extend orthoginal to bow string 28 and be closely adjacent to riser wall 24. The nearness of the arrow shaft 28 to the riser wall 24 brings the shaft closer to the center line marker 25 and facilitates the location of arrow shaft 27 adjacent that center line marker 25.

By sliding tool body 12 upwards or downwards along, bow string 28, arrow shaft 27 may be positioned so that its center line intersects the center line of bow 20 as indicated on marker 25.

Once this juxtaposition of arrow shaft 27 and bow center line marker 25 has been determined, the height of arrow rest 26 is adjusted so as to support arrow shaft 27 at that position.

With arrow shaft 27 positioned to intersect the center line of bow 20, nock points 30 may be positioned above and below arrow shaft 29 on bow string 28 to indicate the proper position on bow string 28 at which arrow shaft 27 is to be nocked preparatory to launching an arrow. Knotted threads or clinched metallic beads 30 may be employed for use as nock points.

Because the archer utilizes his own arrow shaft when establishing the height of the arrow rest and the position of the nock points, a greater accuracy is inherently produced because measurements are being made with the actual device which will be used with the tuned bow.

Figure 6:
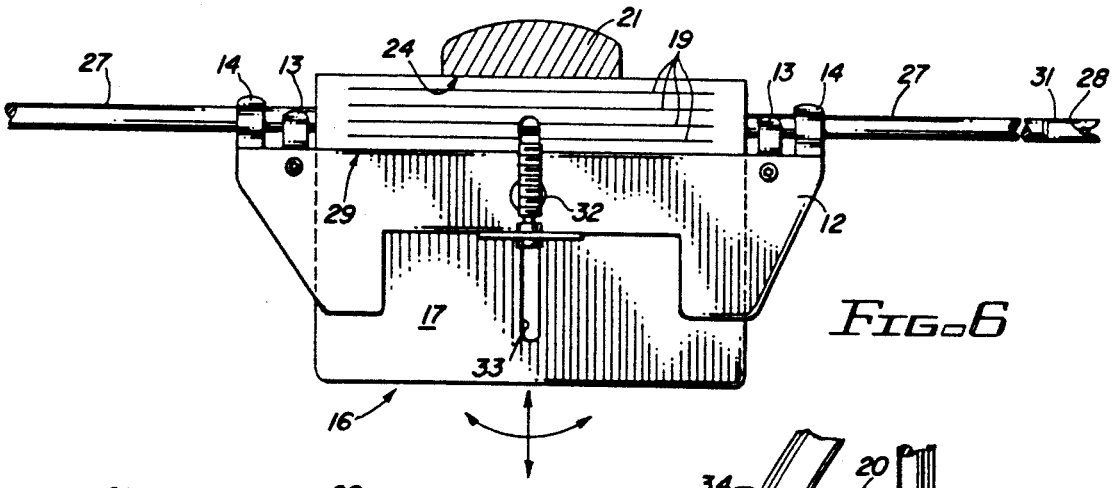
FIG. 6 inserts the tool into the illustration of FIG. 5 to show the manner in which the tool is used as a center set for locating the arrow rest parallel to the surface on the riser of the bow.

Having adjusted the height of the arrow rest, and indicated the proper nocking points on the bow string, the archer will want to assure that the arrow will be launched straight from the bow and not deviate to the left or the right. In essence, this means that the longitudinal axis of the arrow must lie within the plane of movement of the bow string as the string snaps from its released position to launch the arrow. This concept is illustrated in FIG. 2 and in FIG. 6.

Ideally, arrow shaft 27 will travel along a path which is parallel to the face of riser 24 in hand grip 21 of bow 20. To achieve this ideal, the combination tool 10 is utilized as a center set 16. When so used, body 12 is coupled to arrow shaft 27 by means of arrow shaft clips 24 on body 12. In this instance, shaft 27 is equipped with its normal shaft nock 31. Shaft nock 31 is engaged with bow string 28. Arrow shaft 27 is positioned on arrow rest 26, not visible in FIG. 6. Gauge 17 is a slidably which is pivotally and slide coupled to body 12. Pin 32 passes through body 12 and into slot 33 of gauge 17 where it is terminated so as to permit gauge 17 to move inward and outward, toward and away from bow grip 21, and to align its edge with the face of riser 24, even though arrow 27 is not in a parallel relationship with the face of riser 24.

Gauge 17 is provided with gauge marks 19. Gauge marks 19 are viewed with respect to edge 29 of body 12. If gauge marks are skewed with respect to edge 29, then arrow 27 is not in parallel relationship with the face of riser 24. When this occurs, adjustment is made in arrow rest 26 to bring arrow shaft 27 closer to a parallel relationship with the surface of riser 24.

Each time arrow rest 26 is adjusted, gauge 17 is set against the surface of riser 24 and a comparison made between gauge marks 19 and gauge edge 29. When gauge marks 19 and edge 29 assume a parallel relationship, then arrow 27 is also in a parallel relationship with the surface of riser 24. Arrow rest 26 may be locked into position. After locking arrow rest 26 in position, a final check of the alignment may be made.

Figure 7:
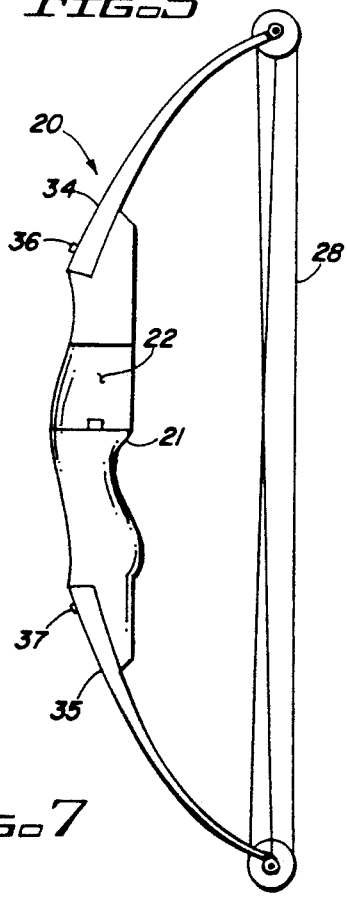
FIG. 7 is a simplified sketch of a compound bow for purposes of showing that the upper and lower limbs of the bow may be adjusted to control the tiller height of the bow.

In the illustration of FIG. 7, bow 20 is a compound bow having an upper limb 34 and a lower limb 35. These limbs are adjustably coupled to bow grip 21 by coupling screws 36 and 37, indicated schematically in the drawings. For simplicity of illustration, exact details of this adjustable coupling are omitted.

The distances D-1 and D-2 are indications of the tiller height of the bow. The tiller height is the distance between the back side of the hand grip 21 and the bow string 28. Adjustment of coupling screws 36 and 37 will affect the inclination of the upper or the lower limb 34 and 35, respectively. This, in turn, will affect the tiller height distances of D-1 and D-2. Ideally, the tiller height should be the same from complementary points at the upper portion of the lower portion of hand grip 21.

Figure 8:
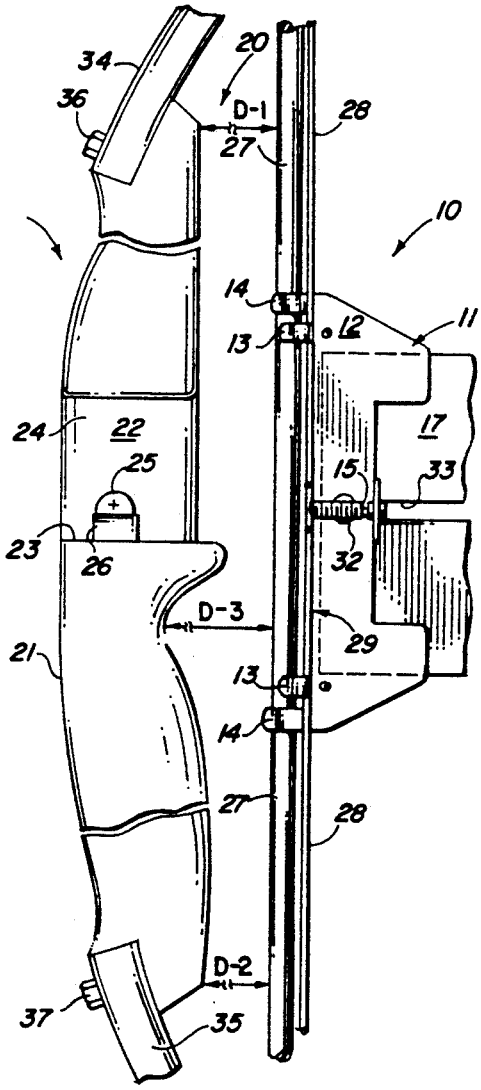
FIG. 8 is a detail of the bow of FIG. 8 showing the tool attached to the bow string and an arrow shaft affixed to the tool to provide a reference surface for measuring the tiller height of the bow at both the upper and lower portions of the bow grip. Adjustments to the inclination of the limb are made to equalize these two dimensions.

Combination tool 10 may be utilized as a tiller gauge to equalize the tiller height measurements D-1 and D-2. Such usage is indicated in FIG. 8. Here, tool 10 is attached to bow string 28 by means of bow string attachment clips 13. Arrow shaft 27 is attached to the tool by means of arrow shaft clips 14. This arrangement places arrow shaft 27 alongside and parallel to bow string 28. Arrow shaft 27 provides an uncluttered surface to be used in equalizing the distances D-1 and D-2. Such an uncluttered surface may not be available to the archer because of nock locators, vibration dampers, and other attachments to the bow string. By measuring the distances D-1 and D-2 and adjusting the adjustment screws 36 and 37, the angular inclination of the upper limb 34 and the lower limb 35, respectively, will be adjusted so as to vary the magintude of the measured distances D-1 and D-2. The adjustment are made until D-1 is equal to D-2. This equalizes the tiller heights both in the upper part of the hand grip and the lower portion, that is, above and below where the archer normally grips the bow. It would appear to be normally good practice to set the tiller height, equalizing distances D-1 and D-2, prior to undertaking any other tuning adjustments of the bow.

The distance D-3 indicated in FIG. 8 is the bracing height, or fistmele, of the bow. This distance is often specified within specific limits for a given bow. The adjustment of tiller heights and bracing height are interactive.

A suggested sequence of adjustments first establishes equal tiller heights D-1 and D-2. The bracing height D-3 is then measured. Coupling screws 36 and 37 are next adjusted in incrimentally equal amounts, clockwise or counterclockwise, as needed to establish the required D-3 measurement while maintaining D-1 and D-2 equal.

What has been described is a bow tuning tool which has two coupling mechanisms. The first of these coupling mechanisms makes coupling contact with the archer's bow. The second makes coupling contact with an arrow shaft. By coupling the arrow shaft to the tool and bringing the tool into coupling contact with the bow, tuning adjustments to the bow are facilitated. A three-in-one bow tuning tool is derived: a Bow Square and Nock Set, used to set the height of an adjustable arrow rest and to locate nock points; a Bow Center set for setting the flight path of the arrow shaft past the bow; and, a Bow Tiller Gauge to equalize the setting of the tiller height above and below the point on the bow at which the bow is gripped.

Those skilled in the art will conceive of other embodiments of the invention which may be drawn from the disclosure herein. To the extent that such other embodiments are so drawn, it is intended that they shall fall within the ambit of protection provided by the claims herein.

Having described the invention in the foregoing description and drawings in such a clear and concise manner that those skilled in the art may readily understand and practice the invention.

That which is claimed is:

1. Apparatus for tuning a bow comprising:

an arrow bow having a bow grip, an upper limb, a lower limb, and a bow string;

an arrow shaft;

a bow tuning tool having first means for making coupling contact with said bow; and second means for making coupling contact with said arrow shaft to hold said arrow shaft in a first selected position;

third means for making coupling contact with said arrow shaft to hold said arrow shaft in a second selected position orthogonal to said first selected position;

where, by coupling said arrow shaft to said tool, and by bringing said tool into coupling contact with said bow, tuning adjustments to said bow are facilitated.

2. The apparatus of claim 1 wherein said arrow shaft has a nock end for receiving an arrow nock and said bow tuning tool is a Bow Square and Nock Set useful in setting the height of an adjustable arrow rest mounted on said bow, and in locating nock points on said bow string;

said first means movably couples said tool to said bow string; and said second means couples said tool to said nock end of said arrow shaft, said arrow shaft lying in a plane orthogonal to said bow string and extending toward said bow when said tool is movably coupled to said bow string.

3. The apparatus of claim 1 wherein said arrow shaft has an arrow nock in said nock end and said bow tuning tool is a Bow Center Set useful in setting the flight path of said arrow shaft past said bow;

said first means comprises angular observation means, adjustably coupled to said tool, and movably coupling said tool to said bow along the flight path of said arrow shaft; and said third means comprises means coupling said tool to said arrow shaft while said arrow shaft is nocked to said bowstring, said arrow shaft lying on a line extending past said bow at an angular disposition indicated by said angular observation means, said tool facilitating the setting of that angular disposition.

4. The apparatus of claim 1 wherein said bow has first and second adjustment means coupling, respectively, said upper and said lower limbs to said bow grip, and said bow tuning tool is a Bow tiller Gage useful in facilitating equalization of the setting of the fistmele, and the bracing height, above and below said bow grip;

said first means movably coupling said tool to said bow string; and said third means coupling said arrow shaft to said tool, and maintaining said arrow shaft along a line parallel to said bow string when said tool is coupled to said bow string.

5. The apparatus of claim 1 wherein said bow tuning tool comprises, in combination:

a Bow Square and Nock Set useful in setting the height of an adjustable arrow rest mounted on said bow, and in locating nock points on said bow string, a Bow Center Set useful in setting the flight path of said arrow shaft past said bow, and a Bow Tiller Gage useful in facilitating equalization of the setting of the bracing height, above and below said bow grip and setting the fistmele;

said arrow shaft has a nock end; and said bow has first and second adjustment means coupling, respectively, said upper and said lower limbs to said bow grip;

in using said apparatus as a Bow Square and Nock Set, said first means movably couples said tool to said bow string; and said second means couples said tool to said nock end of said arrow shaft, said arrow shaft lying in a plane orthogonal to said bow string and extending toward said bow when said tool is movably coupled to said bow string;

in using said apparatus as a Bow Center Set, said first means further comprises angular observation means, adjustably coupled to said tool, and movably coupling said tool to said bow along the flight path of said arrow shaft; and said third means couples said tool to said arrow shaft while said arrow shaft is nocked to said bowstring, said arrow shaft lying on a line extending past said bow at an angular disposition indicated by said angular observation means, said tool facilitating the setting of that angular disposition;

in using said apparatus as a Bow Tiller Gage, said first means movably couples said tool to said bow string; and said third means couples said arrow shaft to said tool, said arrow shaft lying along a line parallel to said bow string when said tool is coupled to said bow string.

6. Apparatus for tuning a bow comprising a bow square nock set, a bow center set, and a tiller gauge, said bow square nock set comprising:

a tool body having a first edge;

bow string attachment means coupled to said tool body for attaching said tool body to a bow string of a bow and maintaining said first edge adjacent said bow string when said tool body is attached to said bow string for use as a bow square nock set;

arrow shaft attachment means coupled to said tool body for attaching an arrow shaft to said tool body and maintaining said arrow shaft parallel to said first edge of said tool body; and arrow shaft coupling means coupled to said tool body for coupling an arrow shaft offset from a surface of said tool body and orthogonal to and offset from said first edge, an arrow shaft so coupled to said tool body lying orthogonal to and offset from a bow string when said tool body is attached to said bow string for use as a bow square nock set.

7. The apparatus of claim 6 wherein said Bow Center Set comprises:

said tool body;

said arrow shaft attachment means coupled to said tool body for attaching an arrow shaft to said tool body and maintaining said arrow shaft parallel to said first edge of said tool body;

an alignment gauge slidingly, pivotally coupled to said tool body, said alignment gauge including a gauge mark, said gauge mark's disposition viewable thereon with respect to said first edge of said tool body, and when said tool body is used a said Bow Center Set, an arrow shaft is attached to said tool body by said arrow shaft attachment means;

said arrow shaft is nocked to the bow string of a bow;

said arrow shaft is further placed in an arrow rest on said bow;

said tool alignment gauge is extended from said tool body so as to contact said bow, and said gauge mark is observed for alignment with said first edge;

said arrow rest being adjusted to position said gauge mark parallel to said first edge.

8. The apparatus of claim 7 wherein said tiller gauge comprises:

said body;

said bow string attachment means;

said shaft arrow attachment means; and when said tool body is used as a tiller gauge, said tool body is attached to the bow string of a bow by said bow string attachment means;

an arrow shaft is attached to said tool body by said arrow shaft attachment means;

said arrow shaft being maintained parallel to said bow string by said arrow shaft attachment means as a guide for equalizing the tiller height of said bow.

9. The apparatus of claim 6 wherein said tiller gauge comprises:

said body;

said bow string attachment means;

said arrow shaft attachment means; and when said tool body is used as a tiller gauge, said tool body is attached to the bow string of a bow by said bow string attachment;

an arrow shaft is attached to said tool body by said arrow shaft attachment means;

said arrow shaft being maintained parallel to said bow string by said arrow shaft attachment means as a guide for equalizing the tiller height of said bow.

* * * * *